US009526976B1

(12) United States Patent
Marshall

(10) Patent No.: US 9,526,976 B1
(45) Date of Patent: Dec. 27, 2016

(54) SKATEBOARD ASSEMBLY INCLUDING A FLUID-FILLED CHAMBER

(71) Applicant: NIKE, Inc., Beaverton, OR (US)

(72) Inventor: Eric Joseph Marshall, Tualatin, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/947,161

(22) Filed: Nov. 20, 2015

(51) Int. Cl.
*A63C 17/02* (2006.01)
*A63C 17/00* (2006.01)
*A63C 17/01* (2006.01)

(52) U.S. Cl.
CPC ..... *A63C 17/0046* (2013.01); *A63C 17/012* (2013.01); *A63C 17/015* (2013.01)

(58) Field of Classification Search
CPC . A63C 17/0046; A63C 17/012; A63C 17/011; A63C 17/014; A63C 17/015
USPC ..... 280/87.01, 87.021, 87.041, 87.042, 280/87.043
See application file for complete search history.

(56) References Cited

U.S. PATENT DOCUMENTS 5,052,702 A * 10/1991 Chan ..... A63C 17/01 280/11.28
7,219,907 B2 * 5/2007 Chang ..... A63C 17/0093 280/11.225
8,752,849 B1 * 6/2014 Fox ..... A63C 17/0093 280/87.042
8,870,199 B2 * 10/2014 Fehn ..... A63C 17/0046 280/11.27

* cited by examiner

*Primary Examiner* — John Walters
(74) *Attorney, Agent, or Firm* — Honigman Miller Schwartz and Cohn LLP; Matthew H. Szalach; Jonathan P. O'Brien

(57) ABSTRACT

A skateboard assembly is provided and includes a deck having an upper surface and a lower surface formed on an opposite side of the deck than the upper surface and a truck assembly including an axle and at least one wheel rotatably supported by the axle. The skateboard assembly also includes a riser having a fluid-filled chamber disposed between the truck assembly and the lower surface of the deck.

27 Claims, 6 Drawing Sheets

SKATEBOARD ASSEMBLY INCLUDING A FLUID-FILLED CHAMBER

FIELD

The present disclosure relates generally to a skateboard assembly and more particularly to a skateboard assembly including a fluid-filled riser.

BACKGROUND

This section provides background information related to the present disclosure and is not necessarily prior art.

Skateboards have been used as recreational devices and/or as a means of personal transportation for many years. To propel the skateboard, the user typically places one foot on the deck, and uses the other foot to push against the ground. Skateboards often include a deck, two truck assemblies mounted to an underside of the deck, and a pair of wheels mounted to each truck assembly. Skateboards also may include a riser located between the deck and each truck assembly that can offset, or create a larger space between, the wheels and the deck. In this way, the riser can help to prevent the wheels from rubbing against the underside of the deck during use. The riser can also prolong the life of the skateboard deck by reducing the strain imparted on the deck by the truck assemblies. For example, skateboards without risers may incur stress cracks where the truck assemblies meet the skateboard deck. While known risers have proven acceptable for their intended use, a continuous need in the relevant art remains for an improved riser and skateboard assembly.

SUMMARY

This section provides a general summary of the disclosure, and is not a comprehensive disclosure of its full scope or all of its features.

A skateboard assembly is provided and includes a deck having an upper surface and a lower surface formed on an opposite side of the deck than the upper surface and a truck assembly including an axle and at least one wheel rotatably supported by the axle. The skateboard assembly also includes a riser having a fluid-filled chamber disposed between the truck assembly and the lower surface of the deck.

In one configuration, the fluid-filled chamber includes a first barrier layer and a second barrier layer joined together by a seal to define an interior void. The interior void may contain a pressurized fluid. The first barrier layer may oppose the lower surface of the deck and the second barrier layer may oppose the truck assembly.

A tensile member may be disposed within the interior void and may include a first substrate attached to the first barrier layer, a second substrate attached to the second barrier layer, and a plurality of tensile members extending between and connecting the first substrate and the second substrate. The first substrate may be substantially parallel to the second substrate. Alternatively, the first substrate may be positioned at an angle substantially between 1 degree (1°) and twenty five degrees (25°) relative to the second substrate. The tensile members may each include substantially the same height in a direction extending between the first substrate and the second substrate. Alternatively, the tensile members may include different heights in a direction extending between the first substrate and the second substrate.

In one configuration, an aperture may extend through the fluid-filled chamber. A fastener may be received within the aperture and may connect the truck and the fluid-filled chamber to the deck.

In another configuration, a skateboard assembly is provided and includes a deck, at least one wheel attached to the deck, and a fluid-filled chamber that is attached to the deck and permits movement of the deck relative to the at least one wheel.

The fluid-filled chamber may include a first barrier layer and a second barrier layer joined together by a seal to define an interior void. The interior void may contain a pressurized fluid.

A tensile member may be disposed within the interior void and may include a first substrate attached to the first barrier layer, a second substrate attached to the second barrier layer, and a plurality of tensile members extending between and connecting the first substrate and the second substrate. The first substrate may be substantially parallel to the second substrate. Alternatively, the first substrate may be positioned at an angle substantially between 1 degree (1°) and twenty five degrees (25°) relative to the second substrate. The tensile members may each include substantially the same height in a direction extending between the first substrate and the second substrate. Alternatively, the tensile members may include different heights in a direction extending between the first substrate and the second substrate.

In one configuration, an aperture may extend through the fluid-filled chamber. A fastener may be received within the aperture and may connect the fluid-filled chamber to the deck.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
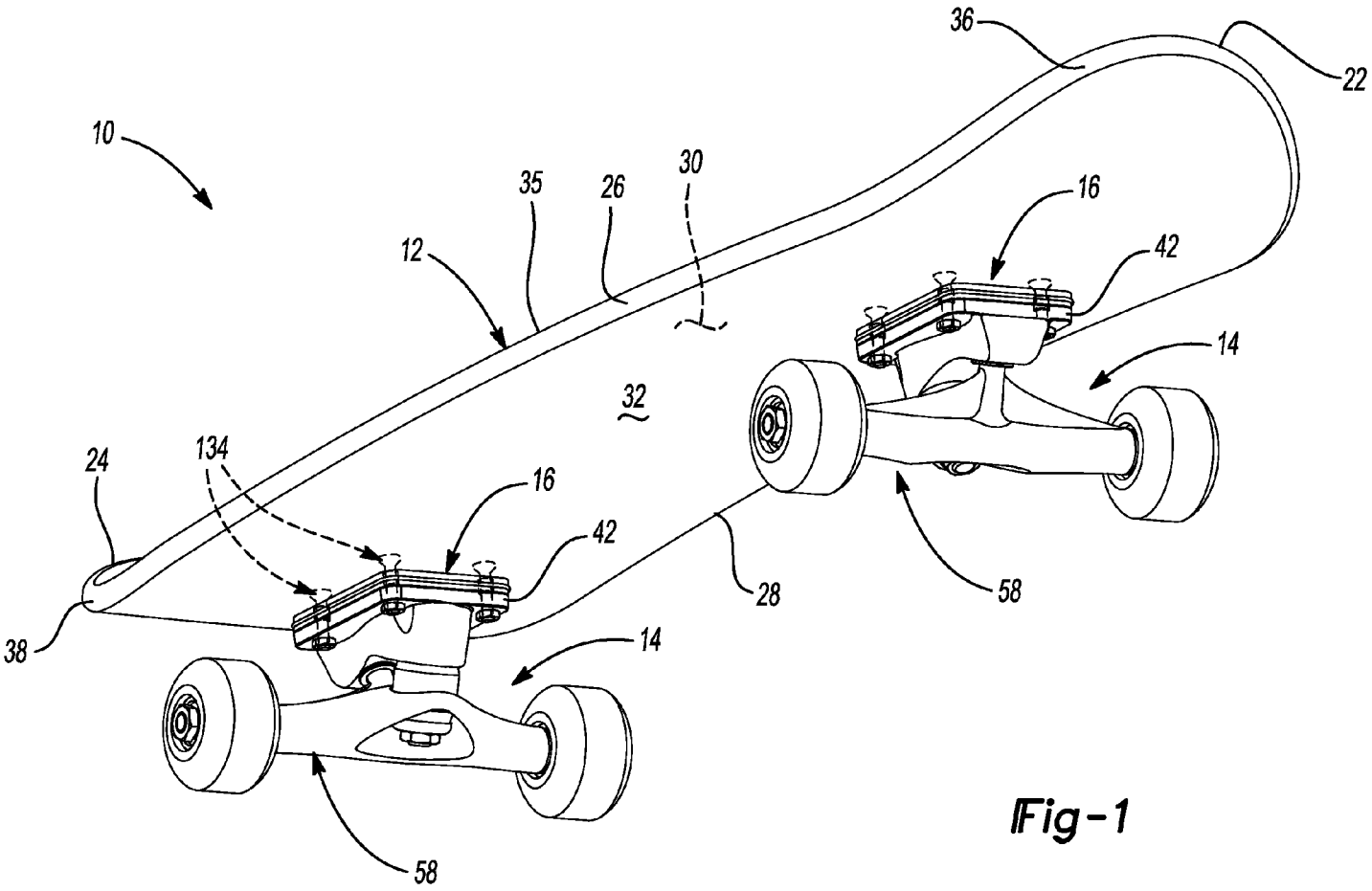
FIG. 1 is a bottom perspective view of a skateboard assembly including a riser constructed in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Figure 2:
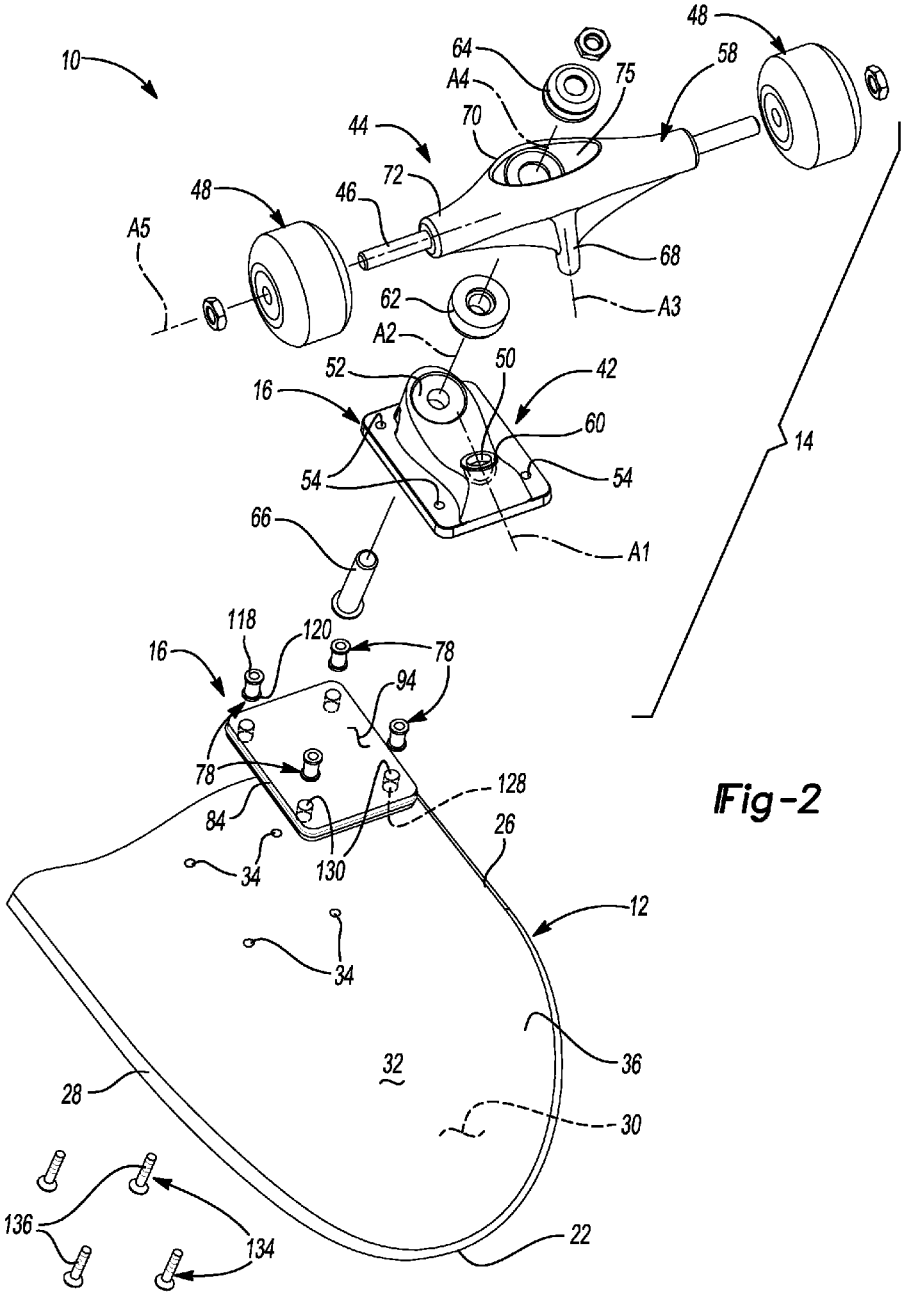
FIG. 2 is a partial exploded view of the skateboard assembly of FIG. 1.
Figure 3:
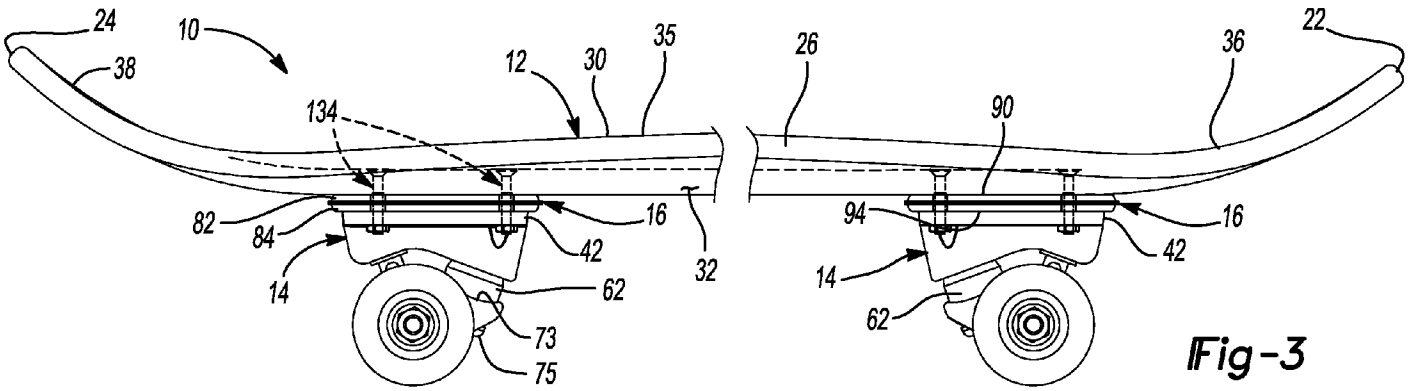
FIG. 3 is a side view of the skateboard assembly of FIG. 1.

With reference to FIGS. 1-3, a personal transportation device (e.g., a skateboard assembly 10) in accordance with the principles of the present disclosure is illustrated. The skateboard assembly 10 may include a deck 12, one or more truck assemblies 14, and one or more risers 16. While the skateboard assembly 10 is generally illustrated as being a shortboard-type skateboard, it will be appreciated that the skateboard assembly 10 may include other forms of board-type transportation equipment within the scope of the present disclosure. For example, the skateboard assembly 10 may include a longboard-type assembly, a pennyboard-type assembly, a snakeboard-type assembly, or a caster board-type assembly. It will also be appreciated that, while the personal transportation device is generally illustrated and described herein as being a skateboard assembly 10, the personal transportation device may include other forms of a personal transportation device, such as a scooter, within the scope of the present disclosure.

The deck 12 may be constructed from one or more of a variety of materials, including, but not limited to, metal, glass, fiberglass, plastic, wood, and the like. In this regard, the deck 14 may be constructed from any material or combination of materials that allows the deck 14 to support at least one truck assembly 14 and at least one riser 16. In some configurations, the deck 12 includes a proximal end 22 (e.g., a nose), a distal end 24 (e.g., a tail), a first lateral side 26, a second lateral side 28, an upper surface (e.g., a foot-receiving surface) 30, a lower surface (e.g., a truck-receiving surface) 32, and a plurality of apertures 34 (FIG. 2). The proximal end 22 may be opposite the distal end 24. The first lateral side 26 may be opposite the second lateral side 28. The first and second lateral sides 26, 28 may extend from the proximal end 22 to the distal end 24. The upper surface 30 may be formed on an opposite side of the deck 12 than the lower surface 32. The upper and lower surfaces 30, 32 may extend from the proximal end 22 to the distal end 24 and from the first lateral side 26 to the second lateral side 28. The apertures 34 may extend through the deck 12, from and between the upper and lower surfaces 30, 32.

The deck 12 may define various shapes and configurations extending from the proximal end 22 to the distal end 24 and from the first lateral side 26 to the second lateral side 28. For example, the deck 12 may include a central portion 35, a proximal portion 36 extending from the central portion 35 to the proximal end 22, and a distal portion 38 extending from the central portion 35 to the distal end 24. In some configurations, the proximal and/or distal end portion 36, 38 may be inclined relative to the central portion 35. In other configurations, the deck 12, including the upper and lower surfaces 30, 32 thereof, may define other shapes, such as an arcuately-shaped construct (e.g., concave or convex) or a W-shaped construct.

In some configurations, the deck 12 may include eight apertures 34. For example, the deck 12 may include four apertures 34 disposed proximate to the proximal end 22 and four apertures 34 disposed proximate to the distal end 24. As will be explained in more detail below, the apertures 34 disposed proximate to the proximal and distal ends 24, 26 may align with corresponding apertures disposed in one of the truck assemblies 14 and/or one of the risers 16.

The truck assembly 14 may be constructed from one or more of a variety of materials, including a plastic and/or a metal alloy, such as aluminum and/or titanium, for example. As illustrated in FIG. 2, the truck assembly 14 may include a base plate 42, a hangar assembly 44, an axle 46, and one or more wheels 48. The base plate 42 may include a pivot cup 50 defining a first pivot axis A1, a support cup 52 defining a first support axis A2, and a plurality of apertures 54. The first pivot axis A1 may extend in a direction transverse to the first support axis A2. For example, in some configurations, the first support axis A2 may extend in a direction substantially perpendicular to the upper surface 30 of the deck 12, and the first pivot axis A1 may form an angle between 15 degrees (15°) and 75 degrees (75°) with the first support axis A2. The orientation of the first pivot axis A1 and the first support axis A2 allows the hangar assembly 44 and axle 46 to rotate relative to the deck 12.

The apertures 54 may be disposed in a peripheral portion of the base plate 42. In this regard, the quantity and arrangement of the apertures 54 may correspond to the quantity and arrangement of the apertures 34 in the deck 12. For example, in some configurations, the base plate 42 may define a generally rectangular shape, and each of the apertures 54 may be disposed in a respective corner of the rectangular-shaped base plate 42, such that four of the apertures 54 align with four of the apertures 34 in the deck 12.

The hanger assembly 44 may include a hanger 58, a pivot bushing 60, an upper support bushing 62, a lower support bushing 64, and a support fastener 66 (e.g., a kingpin, tension bolt, or the like). The hanger 58 may include a pivot arm 68 defining a second pivot axis A3, a support arm 70 defining a second support axis A4, and an axle-receiving arm 72 defining an axis of rotation A5. In an assembled configuration, the second pivot axis A3 may be substantially aligned with the first pivot axis A1, and the second support axis A4 may be substantially aligned with the first support axis A2. In particular, the pivot bushing 60 may be coupled to the pivot arm 68 and further disposed within the pivot cup 50 such that the pivot arm 68 and the second pivot axis A3 are allowed to rotate and/or pivot relative to the base plate 42 and the first pivot axis A1.

The upper and lower support bushings 62, 64 may be coupled to the support arm 70. In this regard, the upper support bushing 62 may be disposed on an upper side 73 of the support arm 70, and the lower support bushing 64 may be disposed on a lower side 75 of the support arm 70. The upper support bushing 64 may be further disposed within the support cup 52 such that the support arm 70 and the second support axis A4 are allowed to rotate and/or pivot relative to the base plate 42 and the first support axis A2. For example, the support fastener 66 may be coupled to the support cup 52 and may extend in a direction substantially parallel to the first support axis A2. The support fastener 66 may further extend through the upper and lower support bushings 62, 64 and the support arm 70 to couple the hanger assembly 44 to the base plate 42.

The axle-receiving arm 72 and/or the axis of rotation A5 may extend in a direction transverse to the first and second pivot axes A1, A3, and transverse to the first and second support axes A2, A4. Accordingly, allowing the first pivot axis A1 to rotate and/or pivot relative to the second pivot axis A3, and/or allowing the first support axis A2 to rotate and/or pivot relative to the second support axis A4, allows the axle receiving arm 72 and the axis of rotation A5 to rotate and/or pivot relative to the axes A1-A4 and the deck 12.

The axle 46 may be disposed within and/or extend from the axle-receiving arm 72. In this regard, the axle 46 may extend in a direction substantially parallel to the axis of rotation A5. Each wheel 48 may be supported by and coupled to a respective end of the axle 46 for rotation about the axis of rotation A5.

Figure 4:
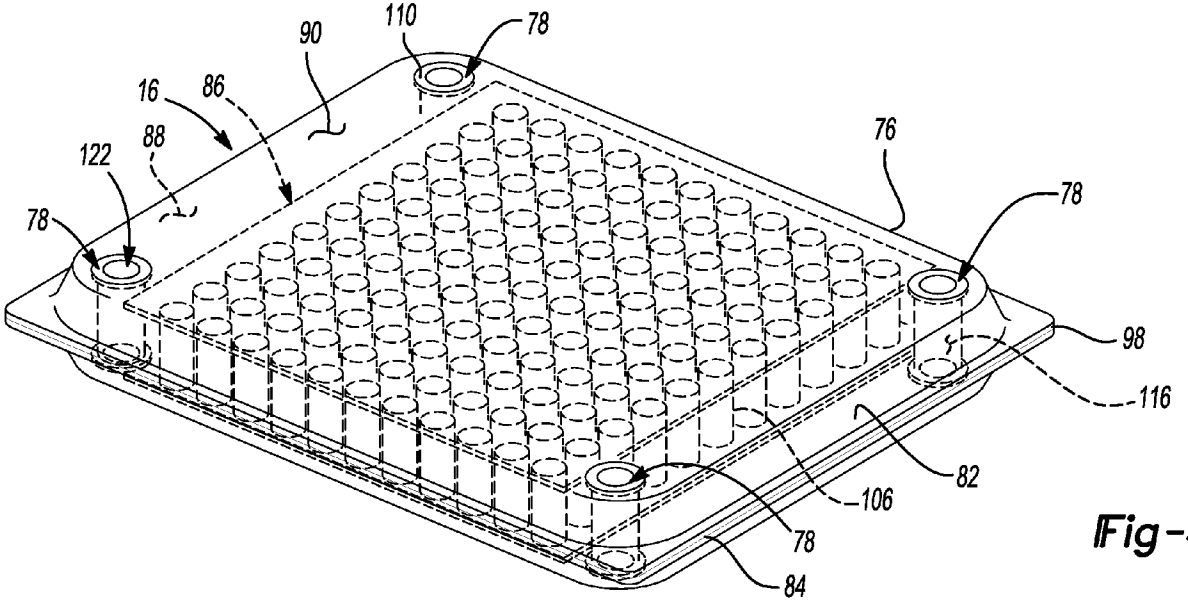
FIG. 4 is a perspective view of the riser of the skateboard assembly of FIG. 1.
Figure 5:
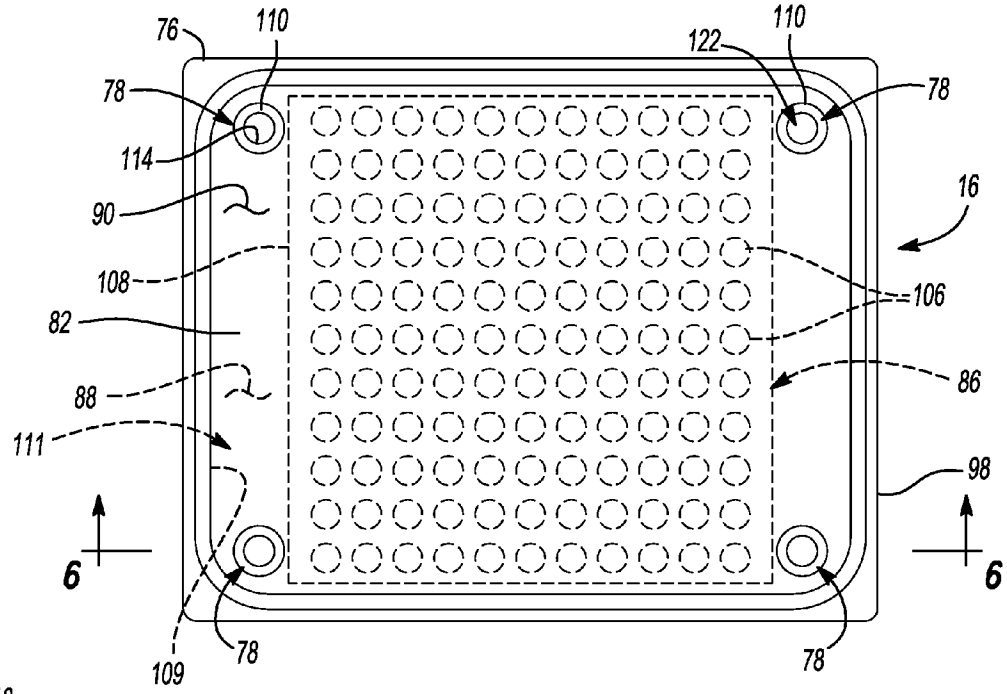
FIG. 5 is a top view of the riser of FIG. 4.
Figure 6:
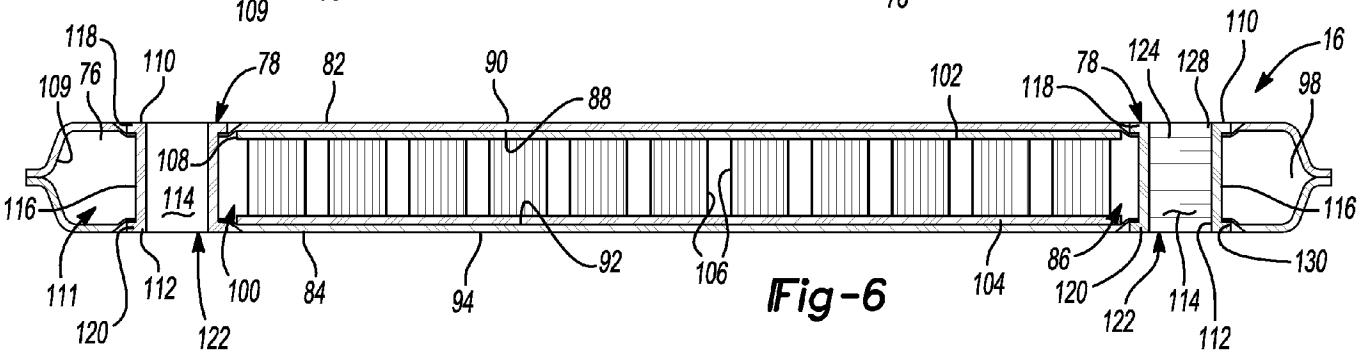
FIG. 6 is a cross-sectional view of the riser of FIG. 4, taken along line 6-6 of FIG. 5.

With reference to FIGS. 4-6, the riser 16 may include a fluid-filled chamber 76 and one or more mounting sleeves 78. The fluid-filled chamber 76 may include a first (e.g., upper) barrier layer 82, a second (e.g., lower) barrier layer 84, and a tensile member 86. The first barrier layer 82 may include a first (e.g., inner) surface 88 and a second (e.g., outer) surface 90, and the second barrier layer 84 may include a first (e.g., inner) surface 92 and a second (e.g., outer) surface 94. As illustrated, the first surface 88 of the first barrier layer 82 may face the first surface 92 of the second barrier layer 84.

The first barrier layer 82 and the second barrier layers 84 may each be formed from a polymer or other material that provides a sealed barrier for enclosing a fluid. For example, the first and/or second barrier layer 82, 84 may be formed from a thermoplastic urethane, polyurethane, polyester, polyester polyurethane, and polyether polyurethane. In this regard, the first and/or second barrier layer 82, 84 may be formed from a material that includes alternating layers of thermoplastic urethane, polyurethane, polyester, polyester polyurethane, and polyether polyurethane.

The first barrier layer 82 may be coupled to the second barrier layer 84 at a seam 98. As illustrated in FIG. 6, in some configurations, the first barrier layer 82 is sealed to the second barrier layer 84 at the seam 98 such that the first surfaces 88, 92 of the first and second barrier layers 82, 84, respectively, collectively define an interior void 100. The interior void 100 may include one or more fluids. For example, air, nitrogen, hexafluorethane, sulfur hexafluoroide, other gases, other fluids, or a mixture thereof, may fill the fluid-filled chamber 76. The first and second barrier layers 82, 84, including the sealed seam 98 therebetween, may maintain the fluid within the interior void 100 at ambient pressure or, alternatively, may maintain the fluid within the interior void 100 at a pressure that is greater than ambient pressure. As will be explained in more detail below, the fluid-filled chamber 76, including the pressure thereof, provides improved cushioning properties by absorbing impact forces created when the wheels 48 strike a ground surface during use.

The tensile member 86 may be disposed within the interior void 100 of the fluid-filled chamber 76 and may include a first (e.g., upper) substrate 102, a second (e.g., lower) substrate 104, and a plurality of individual tensile elements or fibers 106 extending between the first substrate 102 and the second substrate 104. The first and second substrates 102, 104 may include a substantially planar configuration and may be respectively attached to the first barrier layer 82 and the second barrier layer 84 at surfaces 88, 92. Namely, and as illustrated in FIG. 6, the tensile member 86 may be disposed between the first and second barrier layers 82, 84 such that the first substrate 102 engages the first surface 88 of the first barrier layer 82, and the second substrate 104 engages the first surface 92 of the second barrier layer 84. As illustrated in FIGS. 5 and 6, the tensile member 86 may be disposed within the void 100 such that an outer peripheral side 108 of the tensile member 86 and an inner peripheral side 109 of the first and/or second barrier layer 82, 84 define a peripheral chamber 111 therebetween.

The plurality of individual tensile fibers 106, which may deflect easily when a compressive force is applied to the tensile member 86, may include various sizes (e.g., diameter, length, etc.), cross-sectional shapes (e.g., circular, rectangular, or other polygon), and/or materials. When the fluid-filled chamber 76 and/or the tensile member 86 is in a neutral state (i.e., no external force is applied to the fluid-filled chamber 76 and/or the tensile member 86), one or more of the plurality of individual tensile fibers 106 may experience a tensile force in order to maintain a desired shape of the fluid-filled chamber 76 by preventing or inhibiting the first barrier layer 82 from moving away from the second barrier layer 84 beyond a predetermined amount. The tensile fibers 106 may be placed under tension due to the pressure of the fluid contained within the fluid-filled chamber 76. Additional details of tensile fibers 106 are described in U.S. Pat. Nos. 4,906,502, 5,083,361, and 6,385,864, the disclosures of which are fully incorporated herein by reference.

The mounting sleeves 78 may include a proximal end 110, a distal end 112, an inner surface 114, and an outer surface 116. The inner and/or outer surface 114, 116 of the mounting sleeves 78 may extend from the proximal end 110 to the distal end 112 and define a substantially cylindrical shape. In this regard, the inner surface 114 of the mounting sleeve 78 may define an aperture 122 extending from the proximal end 110 to the distal end 112 of the mounting sleeve 78. At least a portion of the inner surface 114 may include a series of threads 124. The proximal end 110 of the mounting sleeve 78 may include a proximal flange 118, and the distal end 112 of the mounting sleeve 78 may include a distal flange 120. The proximal and distal flanges 118, 120 may extend outward from the outer surface 116 of the mounting sleeve 78. In some configurations, the outer surface 116 may generally define a circular shape, such that the proximal and distal flanges 118, 120 extend radially outward from the outer surface 116.

The mounting sleeves 78 may be coupled to the fluid-filled chamber 76. In particular, in some configurations, the mounting sleeves 78 may extend through the first and second barrier layers 82, 84 and through the void 100. For example, the mounting sleeves 78 may extend through the peripheral chamber 111. In this regard, as illustrated in FIGS. 2 and 6, the first barrier layer 82 may include a series of first apertures 128, and the second barrier layer 84 may include a series of second apertures 130. The first and second apertures 128, 130 may be aligned with the peripheral chamber 111. Each first aperture 128 may be aligned with a respective second aperture 130 such that each mounting sleeve 78 is disposed within a respective pair of first and second apertures 128, 130 (i.e., one first aperture 128 and one second aperture 130). The first and second barrier layers 82, 84 may sealingly engage the outer surface 116 of the mounting sleeves 78 within the first and second apertures 128, 130. The proximal flange 118 may sealingly engage the second surface 90 of the first barrier layer 82, and the distal flange 120 may sealingly engage the second surface 94 of the barrier layer 84. The sealing engagement between the mounting sleeves 78 and the first and second barrier layers 82, 84 prevents fluid from escaping the interior void 100 of the fluid-filled chamber 76.

As shown in FIG. 6, while the flanges 118, 120 are respectively described and shown as contacting surfaces 90, 94, the ends 110, 120 of the flanges 118, 120 are also substantially flush with the respective surfaces 90, 94. Such a phenomenon can be accomplished by locally deforming the barrier layers 82, 84 at the location of the flanges 118, 120.

As illustrated in FIG. 5, the position of the mounting sleeves 78 within the fluid-filled chamber 76 may also be such that the tensile member 86 is disposed between the mounting sleeves 78. For example, the mounting sleeves 78 may be disposed about an outer periphery of the fluid-filled chamber 76 such that the mounting sleeves 78 extend through the peripheral chamber 111. In some configurations, each mounting sleeve 78 may be disposed proximate to a respective corner of the fluid-filled chamber 76 such that the tensile member 86 is concentrically disposed between the plurality of mounting sleeves 78.

With reference to FIG. 3, the riser 16 may be located between the deck 12 and the truck assembly 14. For example, the second surface 90 of the first barrier layer 82 may be engaged with the lower surface 32 of the deck 12, and the second surface 94 of the second barrier layer 84 may be engaged with the base plate 42 such that each mounting sleeve 78 (e.g., aperture 122) is aligned with a respective aperture 54 of the base plate 42 and a respective aperture 30 of the deck 12. In some configurations, fasteners 134 may be located within the apertures 34, 54 of the deck 12 and base plate 42, respectively, and within the mounting sleeves 78, to secure the riser 16 relative to the deck 12 and the truck assembly 14. In this regard, the fasteners 134 may include a series of threads 136 that engage the series of threads 124 on the inner surface 114 of the mounting sleeve 76, and/or engage a series of threads (not shown) in the apertures 34, 54 of the deck 12 and base plate 42, respectively. While the first and second barrier layers 82, 84 are illustrated and described herein as being sealingly engaged with the mounting sleeves 78, it will be appreciated that in some configurations, the first and/or second barrier layers 82, 84 may be sealingly engaged with the fasteners 134. In this regard, in some configurations the riser 16 may be formed without the mounting sleeves 78, such that the fasteners 134 are disposed within, and sealingly engaged relative to, the first and second apertures 128, 130 of the first and second barrier layers 82, 84, respectively.

Figure 7:
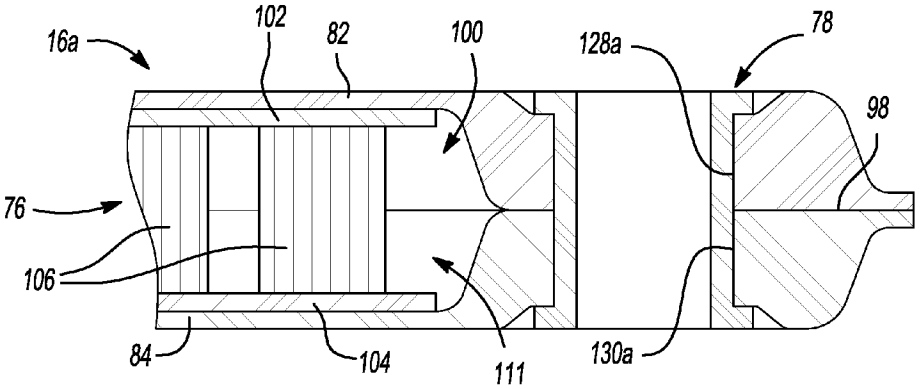
FIG. 7 is a partial cross-sectional view of another riser in accordance with the principles of the present disclosure.

With reference to FIG. 7, another riser **16*a*, for use with the deck 12 and the truck assembly 14, is illustrated. Except as otherwise provided herein, the structure and function of the riser 16*a* may be substantially similar to the structure and function of the riser 16. In view of the substantial similarity in structure and function of the riser 16*a* relative to the riser 16**, like reference numerals are used hereinafter and in the drawings to identify like components, while like reference numerals containing letter extensions are used to identify those components that have been modified. Similar features and components will not be described again in detail.

As illustrated in FIG. 7, the first barrier layer 82 may include at least one first aperture **128*a*, and the second barrier layer 84 may include at least one second aperture 130*a*. Each first aperture 128*a* may be aligned with a respective second aperture 130*a*. In some configurations, the first barrier layer 82 may include four first apertures 128*a* and the second barrier layer 84 may include four second apertures 130*a*. Each of the first and second apertures 128*a*, 130*a* may be disposed about an outer periphery of the riser 16*a*. In some configurations, each of the first and second apertures 128*a*, 130*a* may be disposed in a respective corner of the riser 16*a*. In the assembled configuration, the first and second apertures 128*a*, 130*a* may be formed in, and extend through, the seam 98 of the fluid-filled chamber 76. In this regard, the first and second apertures 128*a*, 130*a* may not communicate with the interior void 100 and/or the peripheral chamber 111**.

Figure 8:
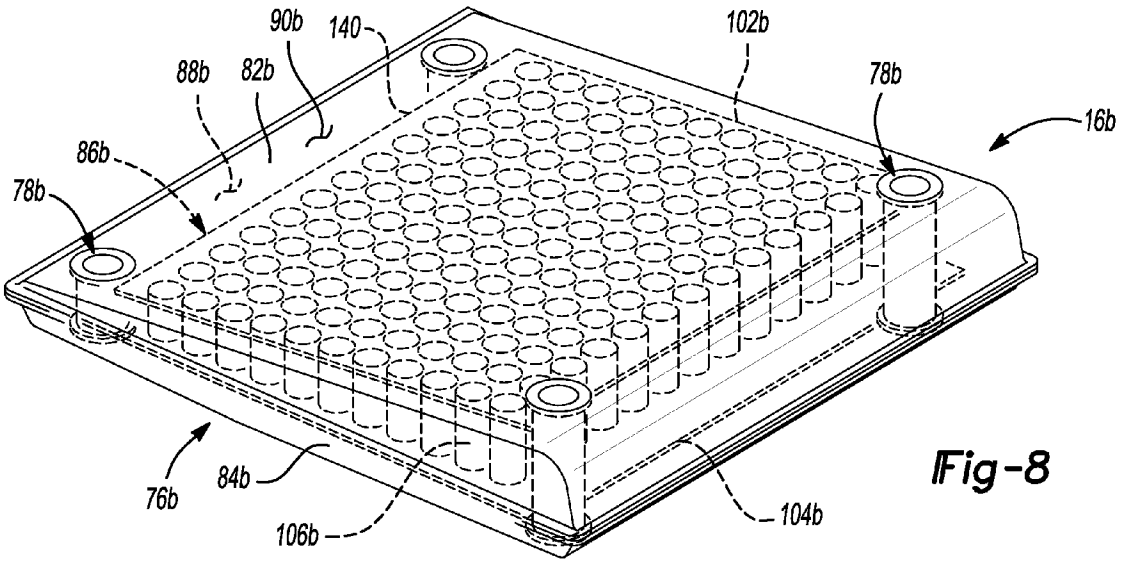
FIG. 8 is a perspective view of yet another riser in accordance with the principles of the present disclosure.
Figure 9:
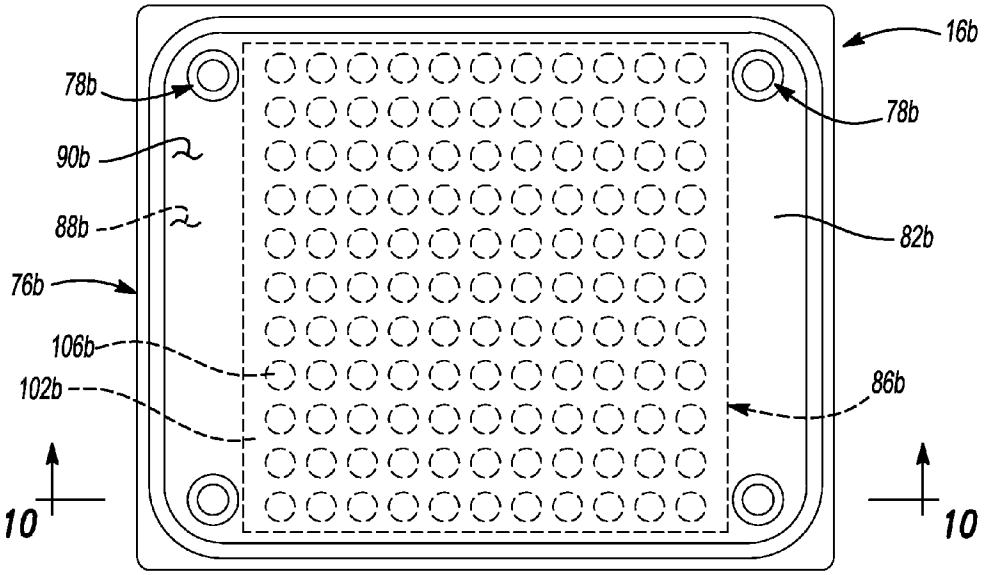
FIG. 9 is a top view of the riser of FIG. 8.
Figure 10:
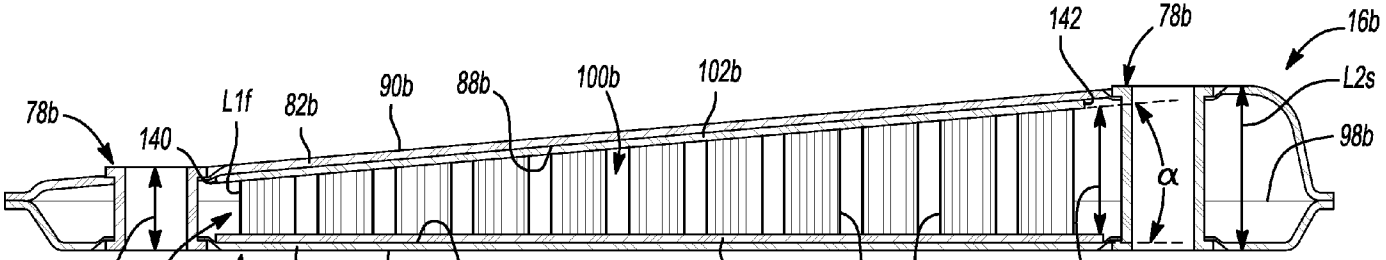
FIG. 10 is a cross-sectional view of the riser of FIG. 9, taken along line 10-10 of FIG. 9.

With reference to FIGS. 8-10, another riser **16*b*, for use with the deck 12 and the truck assembly 14, is illustrated. Except as otherwise provided herein, the structure and function of the riser 16*b* may be substantially similar to the structure and function of the riser 16. In view of the substantial similarity in structure and function of the riser 16*b* relative to the riser 16**, like reference numerals are used hereinafter and in the drawings to identify like components, while like reference numerals containing letter extensions are used to identify those components that have been modified. Similar features and components will not be described again in detail.

The riser **16*b* may include a fluid-filled chamber 76*b* and one or more mounting sleeves 78*b*. The fluid-filled chamber 76*b* may include a first (e.g., upper) barrier layer 82*b*, a second (e.g., lower) barrier layer 84*b*, and a tensile member 86*b*. The first barrier layer 82 may include a first (e.g., inner) surface 88*b* and a second (e.g., outer) surface 90*b*, and the second barrier layer 84 may include a first (e.g., inner) surface 92*b* and a second (e.g., outer) surface 94*b***.

The first barrier layer **82*b* may be coupled to the second barrier layer 84*b* at a seam 98*b*. In some configurations, the first barrier layer 82***b* is sealed to the second barrier layer 84*b* at the seam 98*b* such that the first and second barrier layers 82*b*, 84*b* collectively define an interior void 100*b*.

The tensile member 86*b* may be disposed within the interior void 100*b* of the fluid-filled chamber 76*b* and may include a first (e.g., upper) substrate 102*b*, a second (e.g., lower) substrate 104*b*, and a plurality of individual tensile fibers 106*b* extending between the first substrate 102*b* and the second substrate 104*b*. As illustrated in FIG. 10, the tensile member 86*b* may be disposed between the first and second barrier layers 82*b*, 84*b* such that the first substrate 102*b* engages the second surface 90*b* of the first barrier layer 82*b*, and the second substrate 104*b* engages the first surface 92*b* of the second barrier layer 84*b*.

The plurality of individual tensile fibers 106*b* may define various lengths extending between the first and second substrates 102*b*, 104*b*. For example, as illustrated in FIGS. 8 and 10, the fibers 106*b* located proximate to a first end 140 of the tensile member 86*b* may define a first length L1*f*, and the fibers 106*b* located proximate to a second end 142 of the tensile member 86 may define a second length L2*f* that is greater than the first length L1*f*. The length of the fibers 106*b* may gradually increase in a direction extending from the first end 140 to the second end 142, such that the tensile member 86*b* defines a substantially inclined shape and/or profile extending from the first end 140 to the second end 142 of the tensile member 86*b*. Accordingly, the first and second substrates 102*b*, 104*b* may define an angle α therebetween. The angle α may be between 1 degree (1°) and 25 degrees (25°). In some configurations, the angle α may be substantially equal to 10 degrees (10°).

The riser 16*b* may be located between the deck 12 and the truck assembly 14, as described above with respect to the riser 16. For example, the second surface 90*b* of the first barrier layer 82*b* may be engaged with the lower surface 32 of the deck 12, and the second surface 94*b* of the second barrier layer 84*b* may be engaged with the base plate 42, such that each mounting sleeve 78*b* (e.g., aperture 122) and/or aperture 128, 130 is aligned with a respective aperture 54 of the base plate 42 and a respective aperture 30 of the deck 12, as described above. It will be appreciated that a length of each mounting sleeve 78*b* may be substantially equal to a distance between the first surface 88*b* of the first barrier 82*b* and the first surface 92*b* of the second barrier 84*b* proximate to the apertures 128, 130. In this regard, the mounting sleeve(s) 78*b* located proximate to the first end 140 of the tensile member 86*b* may define a first length L1*s* and the mounting sleeve(s) 78*b* located proximate to the second end 142 of the tensile member 86*b* may define a second length L2*s* that is greater than the first length Lls.

The risers 16*b* may be located in various orientations between the deck 12 and the truck assembly 14 to control a turning radius of the skateboard assembly 10. For example, to increase the turning capability of the skateboard assembly 10, the risers 16*b* can be located such that the first ends 140 of the tensile members 86*b* are respectively oriented toward the proximal end portion 36 and the distal end portion 38 of the deck 14 (i.e., both ends 142 are located proximate to the central portion 35). Conversely, to decrease the turning capability of the skateboard assembly 10, the risers 16*b* can be located such that the second ends 140 of the tensile members 86*b* are oriented toward one another (i.e., end 142 of one of the tensile members 86*b* is located proximate to the proximal end portion 36 and end 142 of the other of the tensile members 86*b* is located proximate to the distal end portion 38).

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A skateboard assembly comprising:

a deck having an upper surface and a lower surface formed on an opposite side of the deck than the upper surface;

a truck assembly including an axle and at least one wheel rotatably supported by the axle; and a riser including a fluid-filled chamber disposed between the truck assembly and the lower surface of the deck.

2. The skateboard assembly of claim 1, wherein the fluid-filled chamber includes a first barrier layer and a second barrier layer joined together by a seal to define an interior void.

3. The skateboard assembly of claim 2, wherein the interior void contains a pressurized fluid.

4. The skateboard assembly of claim 2, wherein the first barrier layer opposes the lower surface of the deck and the second barrier layer opposes the truck assembly.

5. The skateboard assembly of claim 2, further comprising a tensile member disposed within the interior void.

6. The skateboard assembly of claim 5, wherein the tensile member includes a first substrate attached to the first barrier layer, a second substrate attached to the second barrier layer, and a plurality of tensile members extending between and connecting the first substrate and the second substrate.

7. The skateboard assembly of claim 6, wherein the first substrate is substantially parallel to the second substrate.

8. The skateboard assembly of claim 6, wherein the first substrate is positioned at an angle substantially between 1 degree (1°) and twenty five degrees (25°) relative to the second substrate.

9. The skateboard assembly of claim 6, wherein the tensile members each include substantially the same height in a direction extending between the first substrate and the second substrate.

10. The skateboard assembly of claim 6, wherein the tensile members include different heights in a direction extending between the first substrate and the second substrate.

11. The skateboard assembly of claim 1, further comprising an aperture extending through the fluid-filled chamber.

12. The skateboard assembly of claim 11, further comprising a fastener received within the aperture, the fastener connecting the truck assembly and the fluid-filled chamber to the deck.

13. A skateboard assembly comprising:

a deck;

at least one wheel attached to the deck; and a fluid-filled chamber attached to the deck and operable to permit movement of the deck relative to the at least one wheel, the fluid-filled chamber including a first barrier layer and a second barrier layer joined together by a seal to define an interior void.

14. The skateboard assembly of claim 13, wherein the interior void contains a pressurized fluid.

15. The skateboard assembly of claim 13, further comprising a tensile member disposed within the interior void.

16. The skateboard assembly of claim 15, wherein the tensile member includes a first substrate attached to the first barrier layer, a second substrate attached to the second barrier layer, and a plurality of tensile members extending between and connecting the first substrate and the second substrate.

17. The skateboard assembly of claim 16, wherein the first substrate is substantially parallel to the second substrate.

18. The skateboard assembly of claim 16, wherein the first substrate is positioned at an angle substantially between 1 degree (1°) and twenty five degrees (25°) relative to the second substrate.

19. The skateboard assembly of claim 16, wherein the tensile members each include substantially the same height in a direction extending between the first substrate and the second substrate.

20. The skateboard assembly of claim 16, wherein the tensile members include different heights in a direction extending between the first substrate and the second substrate.

21. The skateboard assembly of claim 13, further comprising an aperture extending through the fluid-filled chamber.

22. The skateboard assembly of claim 21, further comprising a fastener received within the aperture, the fastener connecting the fluid-filled chamber to the deck.

23. A skateboard assembly comprising:

a deck;

at least one wheel attached to the deck; and a fluid-filled chamber attached to the deck and operable to permit movement of the deck relative to the at least one wheel, the fluid-filled chamber including an interior void and an aperture extending therethrough.

24. The skateboard assembly of claim 23, wherein the interior void contains a pressurized fluid.

25. The skateboard assembly of claim 23, further comprising a tensile member disposed within the interior void.

26. The skateboard assembly of claim 25, wherein the tensile member includes a first substrate, a second substrate, and a plurality of tensile members extending between and connecting the first substrate and the second substrate.

27. The skateboard assembly of claim 23, further comprising a fastener received within the aperture, the fastener connecting the fluid-filled chamber to the deck.

* * * * *